US006013293A

United States Patent [19]

De Moor

[11] Patent Number: 6,013,293

[45] Date of Patent: Jan. 11, 2000

[54] PACKING RESPIRING BIOLOGICAL MATERIALS WITH ATMOSPHERE CONTROL MEMBER

[75] Inventor: Colette Pamela De Moor, Palo Alto, Calif.

[73] Assignee: Landec Corporation, Menlo, Calif.

[21] Appl. No.: 08/926,928

[22] Filed: Sep. 10, 1997

[51] Int. Cl.[7] ..... A23L 3/3418; B65D 81/20; B65B 25/02

[52] U.S. Cl. ..... 426/106; 426/112; 426/118; 426/395; 426/410; 426/415; 426/419

[58] Field of Search ..... 426/419, 118, 426/395, 415, 106, 112, 410

[56] References Cited

U.S. PATENT DOCUMENTS

| | | | |
|---|---|---|---|
| Re. 34,537 | 2/1994 | Deyrup | 428/35.7 |
| Re. 34,546 | 2/1994 | Deyrup | 525/674 |
| 2,611,709 | 9/1952 | Plagge . | |
| 3,102,777 | 9/1963 | Bedrosian et al. . | |
| 3,423,212 | 1/1969 | Purcell et al. . | |
| 3,450,542 | 6/1969 | Badran et al. . | |
| 3,450,543 | 6/1969 | Badran et al. . | |
| 3,450,544 | 6/1969 | Badran et al. . | |
| 3,507,667 | 4/1970 | Magnen . | |
| 3,625,876 | 12/1971 | Fitko | 260/23.7 |
| 3,630,759 | 12/1971 | Rumberger . | |
| 3,706,410 | 12/1972 | Baker | 29/16 R |
| 3,795,749 | 3/1974 | Cummin et al. | 426/316 |
| 3,798,333 | 3/1974 | Cummin et al. | 426/106 |
| 3,804,961 | 4/1974 | Cummin et al. | 426/415 |
| 3,844,865 | 10/1974 | Elton et al. | 156/229 |
| 3,903,234 | 9/1975 | Ikeda et al. | 264/210 |
| 3,932,692 | 1/1976 | Hirata et al. | 428/474 |
| 3,975,455 | 8/1976 | Falender et al. | 260/827 |
| 4,055,672 | 10/1977 | Hirsch et al. | 426/127 |
| 4,153,659 | 5/1979 | Recktenwald et al. | 264/83 |

FOREIGN PATENT DOCUMENTS

| | | | |
|---|---|---|---|
| 0178218 | 4/1986 | European Pat. Off. . | |
| 230191 | 7/1987 | European Pat. Off. | 426/419 |
| 0270764 | 6/1988 | European Pat. Off. . | |
| 0351115 | 3/1989 | European Pat. Off. . | |
| 0351116 | 3/1989 | European Pat. Off. . | |
| 1590579 | 5/1970 | France . | |
| 2033541 | 12/1970 | France . | |
| 2531042 | 2/1984 | France . | |
| 4717187 | 9/1972 | Japan . | |
| 538781 | 1/1978 | Japan . | |
| 5610459 | 2/1981 | Japan . | |
| 6164031 | 11/1986 | Japan . | |
| 6210141 | 1/1987 | Japan . | |
| 6227438 | 2/1987 | Japan . | |
| 6288640 | 12/1987 | Japan . | |
| 719555 | 3/1980 | Russian Federation | 426/419 |
| 740190 | 6/1980 | Russian Federation . | |
| 829484 | 5/1981 | Russian Federation . | |
| 9216434 | 3/1991 | WIPO . | |
| 9210414 | 6/1992 | WIPO . | |
| 9412040 | 6/1994 | WIPO . | |

OTHER PUBLICATIONS

P. Veeraju and M. Karel, "Controlling Atmosphere In A Fresh–fruit Package," pp. 168–174, 254, Oct. 1966, *Modern Packaging*.

H. Daun & Seymour G. Gilbert, "Film Permeation: The Key to Extending Fresh Produce Shelf Life, " pp. 50–53, Aug. 1974, *Package Engineering*.

*Primary Examiner*—Steven Weinstein
*Attorney, Agent, or Firm*—Sheldon & Mak

[57] ABSTRACT

Packaging of fruit and vegetables, and other respiring biological materials, makes use of an atmosphere-control member comprising a gas-permeable membrane and an apertured cover member over the membrane. The combination results in a control member having a ratio of $CO_2$ transmission rate to $O_2$ transmission rate which is lower than the same ratio for the gas-permeable membrane. This is particularly useful for materials which are preferably stored in an atmosphere containing a relatively high proportion of $CO_2$.

(List continued on next page.)

18 Claims, 2 Drawing Sheets

U.S. PATENT DOCUMENTS 4,176,148 11/1979 Magder et al. ..... 264/41
4,209,538 6/1980 Woodruff ..... 426/314
4,224,347 9/1980 Woodruff ..... 426/106
4,347,844 9/1982 Ohki et al. ..... 128/287
4,350,655 9/1982 Hoge ..... 264/145
4,386,129 5/1983 Jacoby ..... 428/215
4,394,930 7/1983 Korpman ..... 220/444
4,423,080 12/1983 Bedrosian et al. ..... 426/124
4,461,420 7/1984 Horvath ..... 229/43
4,472,328 9/1984 Sugimoto et al. ..... 264/41
4,485,133 11/1984 Ohtusuka et al. ..... 428/35
4,487,791 12/1984 Komatsu et al. ..... 428/35
4,513,015 4/1985 Clough ..... 426/396
4,515,266 5/1985 Myers ..... 206/205
4,528,235 7/1985 Sacks et al. ..... 428/220
4,698,372 10/1987 Moss ..... 521/145
4,704,238 11/1987 Okuyama et al. ..... 264/41
4,705,812 11/1987 Ito et al. ..... 521/92
4,705,813 11/1987 Ito et al. ..... 521/92
4,734,326 3/1988 Hill ..... 428/317
4,769,262 9/1988 Ferrar et al. ..... 428/35
4,830,863 5/1989 Jones ..... 426/118
4,833,172 5/1989 Schwarz et al. ..... 521/62
4,840,823 6/1989 Chigami et al. ..... 428/35.5
4,842,875 6/1989 Anderson ..... 426/118
4,847,145 7/1989 Matsui ..... 428/323
4,861,644 8/1989 Young et al. ..... 428/195
4,863,788 9/1989 Bellairs et al. ..... 428/246
4,876,146 10/1989 Isaka et al. ..... 428/347
4,877,679 10/1989 Leatherman et al. ..... 428/224
4,879,078 11/1989 Antoon, Jr. ..... 264/41
4,883,674 11/1989 Fan ..... 426/118
4,886,372 12/1989 Greengrass et al. ..... 426/118
4,892,779 1/1990 Leatherman et al. ..... 428/220
4,910,032 3/1990 Antoon, Jr. ..... 426/118
4,923,650 5/1990 Antoon, Jr. et al. ..... 264/41
4,923,703 5/1990 Antoon, Jr. ..... 426/118
4,937,115 6/1990 Leatherman ..... 428/36.4
4,939,030 7/1990 Tsuji et al. ..... 428/315.5
4,943,440 7/1990 Armstrong ..... 426/118
4,956,209 9/1990 Isaka et al. ..... 428/35.2
4,960,639 10/1990 Oda et al. ..... 428/34.5
5,008,296 4/1991 Antoon, Jr. et al. ..... 521/91
5,011,698 4/1991 Antoon, Jr. et al. ..... 426/395
5,026,591 6/1991 Henn et al. ..... 428/198
5,032,450 7/1991 Rechlicz et al. ..... 428/196
5,035,933 7/1991 Ilenda et al. ..... 428/36.6
5,045,331 9/1991 Antoon, Jr. ..... 426/118
5,126,197 6/1992 Schinkel et al. ..... 428/349
5,153,039 10/1992 Porter et al. ..... 428/36.92
5,160,768 11/1992 Antoon, Jr. ..... 428/35.2
5,164,258 11/1992 Shida et al. ..... 428/319.3
5,196,262 3/1993 Schwarz et al. ..... 428/315.5
5,221,571 6/1993 Cammiss et al. ..... 428/220
5,254,354 10/1993 Stewart ..... 426/106
5,256,473 10/1993 Kotani et al. ..... 428/218
5,271,976 12/1993 Kondo et al. ..... 428/35.2
5,275,854 1/1994 Maier et al. ..... 428/36.5
5,300,570 4/1994 Ilenda et al. ..... 525/80
5,322,726 6/1994 Dew ..... 428/216
5,332,617 7/1994 Mills et al. ..... 428/215
5,362,531 11/1994 Samuel et al. ..... 428/36.6
5,411,351 5/1995 Lasch et al. ..... 404/14
5,532,053 7/1996 Mueller ..... 428/287

PACKING RESPIRING BIOLOGICAL MATERIALS WITH ATMOSPHERE CONTROL MEMBER

BACKGROUND OF THE INVENTION

1. Field of the Invention

This invention relates to the packaging of biological materials, especially fresh produce.

2. Introduction to the Invention

Fruit and vegetables, and other respiring biological materials, consume oxygen ($O_2$) and produce carbon dioxide ($CO_2$) at rates which depend upon temperature and upon the particular material and the stage of its development. Their storage stability depends on the relative and absolute concentrations of $O_2$ and $CO_2$ in the atmosphere surrounding them, and on temperature. Ideally, a respiring material should be stored in a container having a total permeability to $O_2$ and a total permeability to $CO_2$ which are correlated with (i) the atmosphere outside the package (usually air), (ii) the rates at which the material consumes $O_2$ and produces $CO_2$, and (iii) the temperature, to produce an atmosphere within the container (the "packaging atmosphere") having the desired $O_2$ and $CO_2$ concentrations for preservation of the material. The total permeability to water vapor may also be significant. This is the principle behind the technology of controlled atmosphere packaging (CAP) and modified atmosphere packaging (MAP), as discussed, for example, in U.S. Pat. Nos. 4,734,324 (Hill), 4,830,863 (Jones), 4,842,875 (Anderson), 4,879,078 (Antoon), 4,910,032 (Antoon), 4,923,703 (Antoon), 5,045,331 (Antoon), 5,160,768 (Antoon) and 5,254,354 (Stewart), copending, commonly assigned U.S. patent application Ser. No. 08/759,602 filed Dec. 5, 1996 (Docket No. 10621.2 US), published as International Publication No. WO 96/38495 (Application No. PCT/US96/07939), and European Patent Applications Nos. 0,351,115 and 0,351,116 (Courtaulds). The disclosure of each of these documents is incorporated herein by reference.

The $O_2$ transmission rate (referred to herein as OTR) and $CO_2$ transmission rate (referred to herein as COTR), of a body composed of a particular material, are the amounts of $O_2$ and $CO_2$, respectively, which will pass through a defined area of that body under defined conditions. The total permeabilities of a container to $O_2$ and $CO_2$ depend, therefore, upon the areas, OTRs and COTRs of the various parts of the container.

The preferred packaging atmosphere depends on the stored material. For many materials, the preferred concentration of $O_2$ is less than the preferred concentration of $CO_2$. For example, broccoli is generally best stored in an atmosphere containing 1–2% $O_2$ and 5–10% $CO_2$; berries are generally best stored in an atmosphere containing 5–10% $O_2$ and 10–20% $CO_2$; and cherries are generally best stored in an atmosphere containing 5–8% $O_2$ and 10–20% $CO_2$. In order to produce a packaging atmosphere having a high ratio of $CO_2$ to $O_2$, the container should have a low ratio of total $CO_2$ permeability to total $O_2$ permeability. The term R ratio is used herein to denote the ratio of COTR to OTR for a particular material or the ratio of total $CO_2$ permeability to total $O_2$ permeability of a container or part of a container.

Respiring biological materials are normally stored at temperatures substantially below normal room temperature, but are often exposed to higher temperatures before being used. At such higher temperatures, the respiration rate increases, and in order to maintain the desired packaging atmosphere, the permeability of the container preferably increases sharply between storage temperatures and room temperature.

Respiring biological materials are generally stored in sealed polymeric containers. Conventional polymeric films, when used on their own, do not provide satisfactory packaging atmospheres because their OTR and COTR values are very low and their R ratios are high. Microporous polymeric films, when used on their own, are also unsatisfactory, but for different reasons; namely because their OTR and COTR values are very high and their R ratios close to 1.0. It has been proposed, therefore, to make use of containers which comprise (i) one or more barrier sections which are relatively large in area and are composed of materials having relatively low OTR and COTR values (e.g. are composed of a conventional polymeric film), and (ii) one or more atmosphere-control members which are relatively small in area and are composed of a microporous film, and which provide at least a large proportion of the desired permeability for the whole container.

However, for containers of conventional size, the preferred total $O_2$ permeability, although larger than can be provided by the barrier sections alone, is still so small that the control members need to be very small in area. Such very small control members are difficult to incorporate into containers, and can easily become blocked in use. In addition, the OTR of microporous films does not change much with temperature.

As described in copending commonly assigned application Ser. No. 08/759,602 and corresponding International Publication No. WO 96/38495 (referenced above), much improved results can be obtained through the use of atmosphere-control members composed of a membrane prepared by coating a thin layer of a polymer onto a microporous film. The OTR of these membranes is such that the atmosphere-control members are of practical size. Furthermore, through appropriate choice of the coating polymer, the membranes can have OTRs which increase sharply with temperature. However, although the membranes are very satisfactory for many purposes, they often have R ratios which are higher than is optimal when the desired packaging atmosphere contains a relatively large proportion of $CO_2$.

SUMMARY OF THE INVENTION

I have discovered that if a gas-permeable membrane is covered, on the side exposed to the air, by a relatively gas-impermeable cover member having one or more small apertures therein, the dimensions of the aperture(s) have important and surprising effects on the permeability characteristics of the combination of the membrane and the cover member. In particular, I have discovered that the R ratio of the combination can be substantially less than the R ratio of the membrane itself. The invention is, therefore, particularly useful for containers used for storing materials which are preferably stored in an atmosphere containing a relatively high proportion of $CO_2$.

In a first preferred aspect, this invention provides a container which (a) comprises (i) one or more barrier sections which are relatively impermeable to $O_2$ and $CO_2$, and (ii) one or more atmosphere-control members which are relatively permeable to $O_2$ and $CO_2$; and (b) can be sealed around a respiring biological material to provide a sealed package which is surrounded by air and which contains a packaging atmosphere around the biological material;

at least one said control member comprising (a) a gas-permeable membrane; and (b) an apertured cover member which, when the container has been sealed around a respiring biological material to provide a said sealed package, lies between the gas-permeable membrane and the air surrounding the package;

the gas-permeable membrane having, in the absence of the apertured cover member, (i) an $O_2$ permeability, referred to herein as $OTR_{perm}$, of at least 155,000 ml/m$^2$•atm•24 hr. (10,000 cc/100 in$^2$•atm•24 hr.), and (ii) a permeability ratio of COTR to OTR, referred to herein as $R_{perm}$; and the apertured cover member being composed of (i) a barrier portion having an $O_2$ permeability, referred to herein as $OTR_{bar}$, which is less than 0.5 times $OTR_{perm}$, and (ii) an aperture portion through which the gas-permeable membrane is exposed to the air surrounding the package, the aperture portion being such that the control member has a permeability ratio of COTR to OTR, referred to herein as $R_{control}$, of at most 0.9 times $R_{perm}$.

In a second preferred aspect, this invention provides a package which is stored in air and which comprises (a) a sealed container, and (b) within the sealed container, a respiring biological material and a packaging atmosphere around the biological material;

said container being a container as defined above which has been sealed around the biological material.

In a third preferred aspect, this invention provides an atmosphere-control member suitable for incorporation into a container according to the first aspect of the invention, said atmosphere-control member comprising (a) a gas-permeable membrane; and (b) an apertured cover member;

the gas-permeable membrane having, in the absence of the apertured cover member (i) an $O_2$ permeability, $OTR_{perm}$, of at least 155,000 ml/m$^2$•atm •24 hr. (10,000 cc/100 in$^2$•atm•24 hr.), and (ii) a permeability ratio, $R_{perm}$; and the apertured cover member being composed of (i) a barrier portion having an $O_2$ permeability, $OTR_{bar}$, which is less than 0.5 times $OTR_{perm}$, and (ii) an aperture portion through which the gas-permeable membrane is exposed to the air surrounding the package, the aperture portion being such that the control member has a permeability ratio, $R_{control}$, of at most 0.9 times $R_{perm}$.

BRIEF DESCRIPTION OF THE DRAWING

The invention is illustrated in the accompanying drawings, in which.

DETAILED DESCRIPTION OF THE INVENTION

Figure 1:
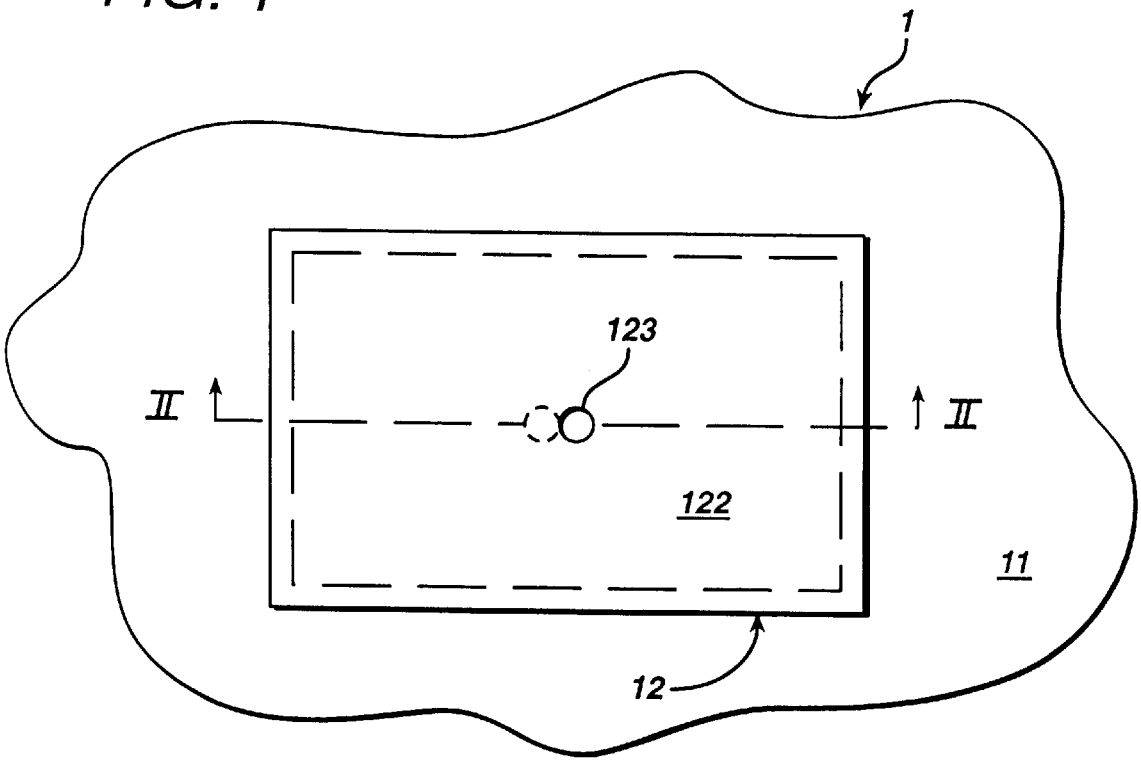
FIGS. 1 and 2 are diagrammatic illustrations of a part of a package of the invention.

In describing the invention, the following abbreviations, definitions, and methods of measurement are used. OTR is $O_2$ permeability; $OTR_{perm}$ is the OTR of the gas-permeable membrane in the absence of the cover member; $OTR_{bar}$ is the OTR of the barrier portion of the cover member; and $OTR_{control}$ is the OTR of the atmosphere-control member. COTR is $CO_2$ permeability; $COTR_{perm}$ is the COTR of the gas-permeable membrane in the absence of the cover member; $COTR_{bar}$ is the COTR of the barrier portion of the cover member; and $COTR_{control}$ is the COTR of the atmosphere-control member. OTR and COTR values are measured at about 22° C. unless otherwise noted, and given in ml/m$^2$•atm•24 hr, with the equivalent in ccl/100 inch$^2$•atm•24 hr. given in parentheses. OTR and COTR values given herein were measured as described below in connection with FIGS. 3 and 4. The abbreviation $P_{10}$ is used to denote the ratio of OTR at a first temperature $T_1$° C. ($OTR_1$) to OTR at a second temperature $T_2$° C. ($OTR_2$), where $T_2$ is ($T_1$−10)° C., $T_1$ being a temperature in the range 10–25° C.; or, when $T_2$ is a temperature which is not ($T_1$−10)° C., but is a temperature lower than $T_1$, to denote the ratio $$P_{10} = \exp\left[\frac{10}{T_1 - T_2} \cdot \ln\left(\frac{OTR_1}{OTR_2}\right)\right]$$

The abbreviation R is used to denote the ratio of COTR to OTR; thus $R_{perm}$ is $COTR_{perm}/OTR_{perm}$, and $R_{control}$ is $COTR_{control}/OTR_{control}$. Pore sizes given in this specification are measured by mercury porosimetry or an equivalent procedure. Percentages are by volume except where otherwise noted. For crystalline polymers, the abbreviation $T_o$ is used to denote the onset of melting, the abbreviation $T_p$ is used to denote the crystalline melting point, and the abbreviation ΔH is used to denote the heat of fusion. $T_o$, $T_p$ and ΔH are measured by means of a differential scanning calorimeter (DSC) at a rate of 10° C./minute and on the second heating cycle.

The novel atmosphere-control members of the invention, in use, form part of a container which is sealed around a respiring biological material. The container can contain a single novel control member, or two or more novel control members (which will usually be the same, but can be different). In some cases, the container can contain a pinhole in order to ensure equalization of the external air pressure and the internal pressure within the container. The invention includes the possibility that the container also contains one or more atmosphere-control members whch are not in accordance with the present invention.

The remainder of the container; i.e. the barrier section or sections, which is of much larger area than the control member(s), is composed of one or more materials which are relatively impermeable to $O_2$ and $CO_2$; e.g. a suitable polymeric film or other shaped article. In some cases, the barrier sections are composed of a material whose OTR and COTR are so low that the packaging atmosphere is substantially determined only by the control member(s). In other cases, the barrier sections have OTR and COTR values which (although low) are high enough that, having regard to the relative large area of the barrier section(s), a substantial proportion of the $O_2$ entering the packaging atmosphere passes through the barrier sections. At 22° C., this proportion can be, for example, as high as 50%, but is generally less than 25%. Typically, the barrier section is provided by a bag of flexible polymeric film or by two preformed, relatively rigid, polymeric members which have been heat-sealed to each other, and the atmosphere-control member covers an aperture cut into the bag or one of the preformed members. The control member(s) can be secured to the barrier section (s) in any way, for example through heat sealing or with an adhesive.

The size and nature of the gas-permeable membrane, and the number and dimensions of the aperture(s) in the cover member, together determine the absolute and relative amounts of $O_2$ and $CO_2$ which can enter and leave the container, and, therefore, the packaging atmosphere within the container. The desired packaging atmosphere will depend upon the biological material within the container, and the temperature, and the atmosphere-control member(s) should be selected accordingly. Those skilled in the art of packaging biological materials will have no difficulty, having regard to the disclosure in this specification and their own knowledge, in designing containers which will give substanially improved results under practical conditions of use and which can be economically manufactured.

The overall size and shape of the control member should be such that the control member can be easily handled and secured to the rest of the container, and positioned on the container so that it will not be damaged or blocked during the packaging operation or during storage. Typically, the control member will be rectangular in shape, with each side of the rectangle being 1 to 4 in (25 to 100 mm). However, other shapes and sizes can be used. The overall dimensions of the gas-permeable membrane and of the cover member will normally be the same as the overall dimensions of the control member. The cover member can be an integral part of a larger member which also provides the barrier sections which surround the control member, for example a polymeric film having a central area to which the gas-permeable membrane is secured and a peripheral area which is part of the barrier section, as illustrated, for example, in FIGS. 1 and 2.

The gas-permeable membrane must have an OTR sufficiently high that having regard to the area of the membrane itself and the number and dimensions of the apertures in the cover member, sufficient $O_2$ is admitted into the container. $OTR_{perm}$ is, therefore, at least 155,000 ml/m$^2$•atm•24 hr (10,000 cc/100 in$^2$•atm•24 hr), preferably at least 310,000 ml/m$^2$•atm•24 hr (20,000 cc/100 in$^2$•atm•24 hr), particularly at least 775,000 ml/m$^2$•atm•24 hr (50,000 cc/100 in$^2$•atm•24 hr). On the other hand, $OTR_{perm}$ should not be too high, since the size of the control member then becomes smaller than is desirable. $OTR_{perm}$ is, therefore preferably less than 3,100,000 ml/m$^2$•atm•24 hr (200,000 cc/100 in$^2$•atm•24 hr), preferably 387,000 to 2,325,000 ml/m$^2$•atm•24 hr (25,000 to 150,000 cc/100 in$^2$•atm•24 hr), particularly 774,000 to 2,325,000 ml/m$^2$•atm•24 hr (50,000 to 150,000 cc/100 in$^2$•atm•24 hr).

As noted above, the R ratio of the atmosphere-control member ($R_{control}$) is substantially less than the R ratio of the gas-permeable membrane alone ($R_{perm}$). But of course, the value of $R_{perm}$ is an important factor in determining $R_{control}$. $R_{perm}$ is usually at least 2, preferably at least 4, e.g. 4 to 6, and can be much higher, for example up to 12. Membranes having high $P_{10}$ values (i.e. whose permeability increases sharply with temperature) often have high R ratios, and one of the advantages of the present invention is that by using such membranes in combination with an apertured cover member, it is possible to produce atmosphere-control members having novel and valuable combinations of relatively low R ratios and relatively high $P_{10}$ values. For the production of control members having high $P_{10}$ values, the gas-permeable membrane, in the absence of the cover member, should have a comparably high $P_{10}$ value; e.g., at least 1.3, preferably, or at least 2.6, over at least one 10° C. range between −5 and 25° C.

Gas-permeable membranes suitable for use in this invention include those described in detail in application Ser. No. 08/759,602 and corresponding International Publication No. PCT/US96/07939 (referenced above), in particular those having an R ratio of at least 2, preferably at least 4. Thus, preferred gas-permeable membranes for use in this invention comprise (a) a microporous polymeric film, and (b) a polymeric coating on the microporous film, the polymeric coating changing the permeability of the microporous film so that the membrane (i) has a $P_{10}$ ratio, over at least one 10° C. range between −5 and 15° C., of at least 1.3, preferably at least 2.6;

(ii) has an oxygen permeability (OTR), at all temperatures between 20° and 25° C., of at least 775,000 ml/m$^2$•atm•24 hr (50,000 cc/100 inch$^2$•atm•24 hr), preferably at least 1,550,000 ml/m$_2$•atm•24 hr (100,000 cc/100 in$^2$•atm•24 hr); and (iii) has a $CO_2/O_2$ permeability ratio (R) of at least 2.0, preferably at least 4.0.

Preferably, the microporous film has at least one of the following characteristics (1) it has an average pore size of less than 0.24 micron, at least 90% of the pores preferably having a size less than 0.24 micron;

(2) it has a tear strength of at least 30 g;

(3) it has a Sheffield Smoothness of at least 30;

(4) it comprises a polymeric matrix comprising an essentially linear ultrahigh molecular weight polyethylene having an intrinsic viscosity of at least 18 deciliters/g, or comprising an essentially linear ultrahigh molecular weight polypropylene having an intrinsic viscosity of at least 6 deciliters/g; and (5) it comprises a finely divided, particulate, substantially insoluble filler which is distributed throughout the film.

Preferably, the coating polymer is coated at a coating weight of 1.7 to 2.9 g/m$^2$ and has one or more of the following characteristics (1) it is a crystalline polymer having a $T_p$ of −5 to 40° C., preferably 0 to 15° C., and a $\Delta H$ of at least 5 J/g, preferably at least 20 J/g;

(2) it is a side chain crystalline polymer, preferably one in which $T_p - T_o$ is less than 10° C., for example a side chain crystalline polymer prepared by copolymerizing (i) at least one n-alkyl acrylate or methacrylate in which the n-alkyl group contains at least 12 carbon atoms and (ii) one or more comonomers selected from acrylic acid, methacrylic acid, and esters of acrylic or methacrylic acid in which the esterifying group contains less than 10 carbon atoms;

(3) it is cis-polybutadiene, poly(4-methylpentene), polydimethyl siloxane, or ethylene-propylene rubber; and (4) it has been crosslinked.

For further details of suitable gas-permeable membranes, reference should be made to the document itself, which is incorporated herein by reference.

The barrier portion of the apertured cover member has an OTR ($OTR_{bar}$) which is substantially less than the OTR of the gas-permeable membrane ($OTR_{perm}$), e.g. less than 0.5 times $OTR_{perm}$, preferably less than 0.05 times $OTR_{perm}$, particularly less than 0.01 times $OTR_{perm}$, and can be such that the barrier portion is substantially impermeable to $O_2$ and $CO_2$. The dimensions of the aperture(s) in the apertured cover member have a surprising effect on the permeability characteristics of the atmosphere-control member. As would be expected, (since only a small proportion of the gas-permeable membrane is directly exposed to the air) the absolute amounts of $O_2$ and $CO_2$ passing through the membrane are reduced. However, the reduction is not as great as would be expected and, more important, the R ratio of the combination of the membrane and the cover member ($R_{control}$) is unexpectedly lower than the R ratio of the membrane itself ($R_{perm}$). The extent of the reduction in the R ratio depends upon the proportion of the membrane which is exposed (i.e. the total area of the aperture or apertures) and the dimensions of the individual aperture(s). The desired reduction in R ratio depends upon the value of $R_{perm}$ and the material to be packaged. $R_{control}$ is at most 0.9 times $R_{perm}$, preferably at most 0.8 times $R_{perm}$. In many cases a substantially greater reduction. e.g. such that $R_{control}$ is at most 0.5 times $R_{perm}$, is desirable and can be achieved without difficulty. The value of ($R_{perm}$–$R_{control}$) is preferably at least 1.0, particularly at least 2.0.

The gas-permeable membrane has an area $A_{perm}$, and the aperture portion of the cover member has an area, $A_{open}$. $A_{open}$ is generally at most 0.15 times $A_{perm}$, preferably at most 0.04 times $A_{perm}$. Depending on the desired reduction in R ratio, $A_{open}$ is often less than 0.02 times $A_{perm}$. The area of each aperture, $A_{aperture}$ is also important. $A_{aperture}$ is generally less than 0.35 $in^2$ (2.25 $mm^2$), for example 0.015 to 0.15 $in^2$ (9.7 to 97 $mm^2$), preferably 0.05 to 0.15 $in^2$ (32 to 97 $mm^2$), again depending on the desired reduction in R ratio. The apertures can be of any convenient shape, e.g. circular, oval, or irregular. The periphery of each aperture generally has a length less than 2 in (51 mm), for example 0.14 to 1.4 in (3.5 to 35 mm), preferably 0.8 to 1.4 in (20 to 35 mm).

The apertures can be produced in the cover member by completely removing a portion of the initial film. However, I have obtained more consistent results when all but a small part of the periphery of the aperture is cut through, and the resulting flap is folded so that it lies between the gas-permeable membrane and the cover member. This results in a "tented" configuration which increases the area of the membrane which is directly exposed to the air. I have observed that in some cases, even when there is no flap of this kind, after a period of equilibration, the gases entering and leaving the container produce a small separation between the membrane and the cover member around the periphery of the aperture, resulting in a similar configuration.

Figure 2:
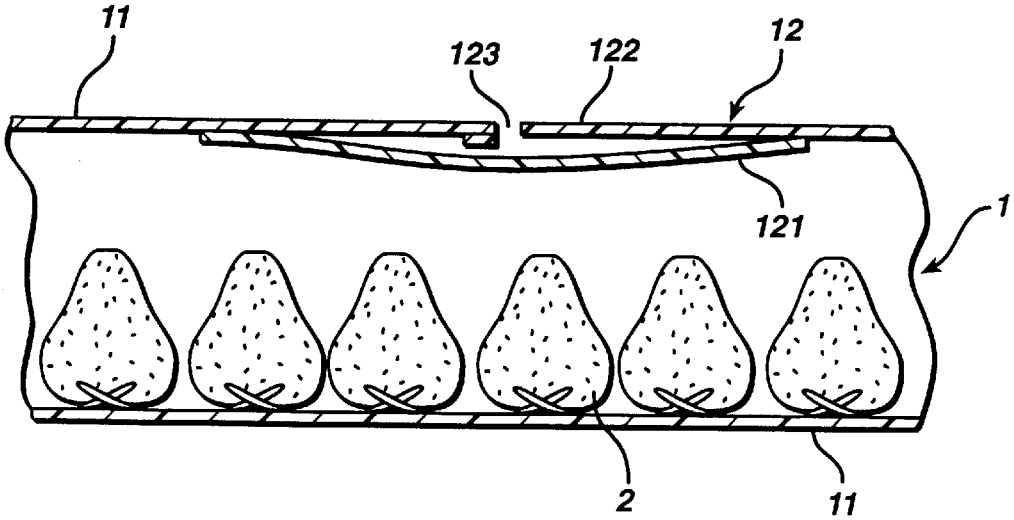

Referring now to the drawings, FIG. 1 is a plan view of part of a package of the invention, and FIG. 2 is a cross section taken on line II, II of FIG. 1. Both FIG. 1 and FIG. 2 are diagrammatic in nature and are not to scale; in particular the thicknesses of the various films have been exaggerated in FIG. 2 in the interests of clarity. In FIGS. 1 and 2, the package comprises a sealed container 1 which contains strawberries 2. The container 1 is composed of barrier sections 11 of a substantially impermeable polymeric film and an atmosphere control member 12. The control member comprises a gas-permeable membrane 121 and an apertured cover member 122. The membrane 121 is heat sealed to the underside of the cover member 122, so that the cover member lies between the membrane and the air surrounding the sealed container. The apertured cover member is integral with the top barrier section 11 (and is, therefore, composed of a substantially impermeable polymeric film) and has an aperture 123 in the center thereof. The aperture 123 has been produced by cutting almost all the way around a circle, and folding the resulting flap under the cover member so that it lies between the gas-permeable membrane and the cover member.

Figure 3:
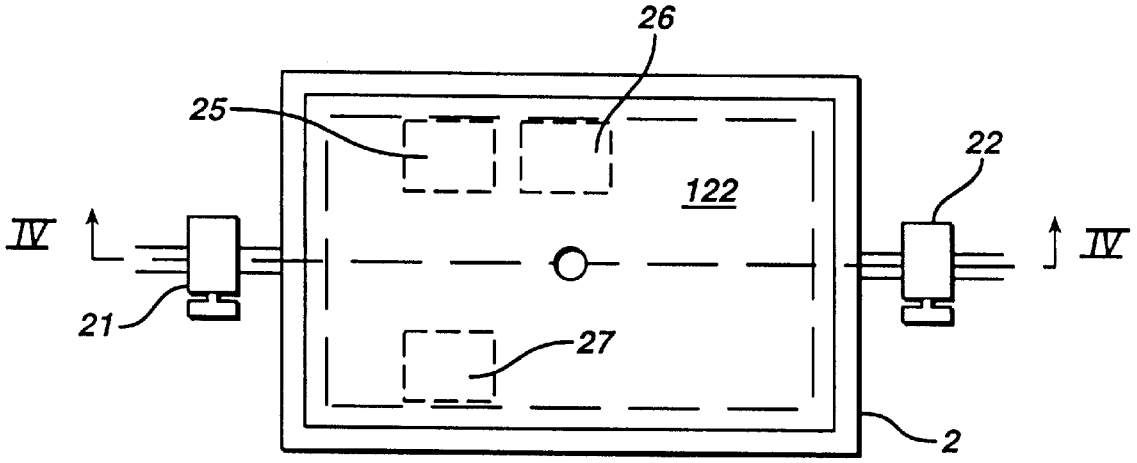
FIGS. 3 and 4 are diagrammatic illustrations of the test set-up used in the Examples.
Figure 4:
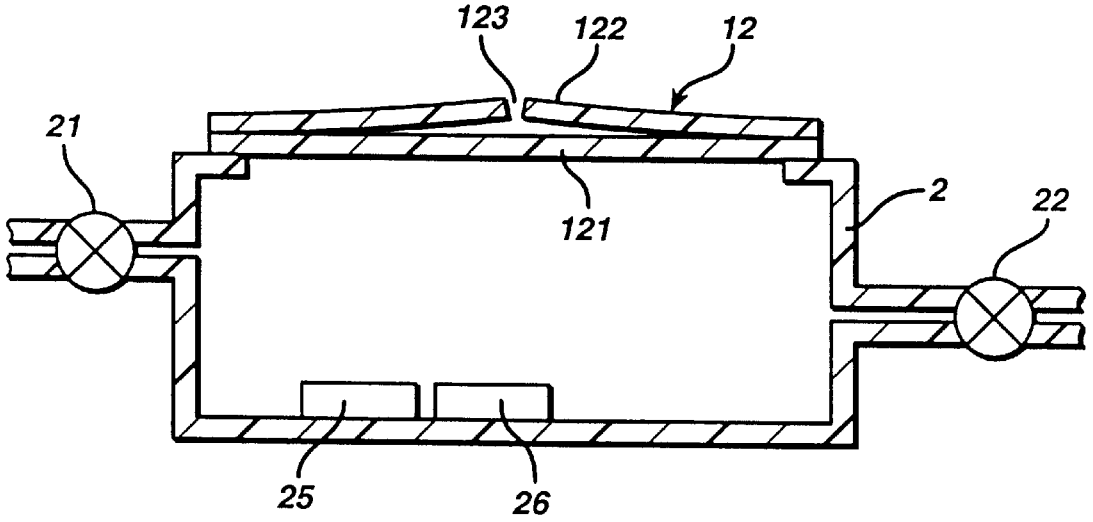

FIG. 3 is a plan view of a part of the test set-up used in the Examples below, and FIG. 4 is a cross section taken on line IV—IV of FIG. 3. Like FIGS. 1 and 2, FIG. 3 and FIG. 4 are diagrammatic in nature and are not to scale. FIGS. 3 and 4 show an impermeable box 2 which is surrounded by air, which has an open top, and which is fitted with valves 21 and 22, an $O_2$ sensor 25, a $CO_2$ sensor 26, and a pressure sensor 27. An atmosphere-control member 12 which is to be tested is sealed over the open top of the box, using double-sided adhesive tape. The control member 12 comprises a gas-permeable membrane 121 and an apertured cover member 122 having one or more circular apertures 123 therein (a single aperture being shown in FIGS. 3 and 4). To test the control member, the box is first filled with a mixture of 15% $CO_2$, 3% $O_2$ and 82% nitrogen which is supplied through valve 21 and removed through valve 22 for a time sufficient to ensure that the desired gas mixture is present within the box. Valves 21 and 22 are then closed. The data generated by the $O_2$ sensor 25, the $CO_2$ sensor 26 and the pressure sensor 27 (as the gas mixture equilibrates with the air outside the box) are passed to a computer (not shown), and are used to calculate OTR and COTR values for the control member (based on the total area of the gas-permeable membrane), using the technique described in "Exponential Decay Method for Determining Gas Transmission Rate of Films" by L. Moyls, R. Hocking, T. Beveridge, G. Timbers (1992) Trans. of the ASAE 35:1259–1266.

The invention is illustrated by the following examples, which are summarized in the tables below. In each of the examples, the OTR and COTR of a gas-permeable membrane were measured as described in connection with FIGS. 3 and 4, and the R ratio was calculated. The membrane was then covered by an apertured cover member which had one or more round apertures in it. The OTR and COTR of the resulting covered membrane were measured, and the R ratio calculated. The tables below show the reduction in OTR (i.e. the difference between the OTR of the membrane on its own, $OTR_{perm}$, and the OTR of the covered membrane, $OTR_{control}$) expressed as a percentage of $OTR_{perm}$, and the reduction in R ratio (i.e. the difference between the R ratio of the membrane on its own, $R_{perm}$, and the R ratio of the covered membrane, $R_{control}$) expressed as a percentage of $R_{perm}$.

In each of the Examples, the gas-permeable membrane was a microporous film which had been coated with a polymer, and the cover member was prepared from a film which was substantially impermeable to $O_2$ and $CO_2$, as further identified below. It should be noted that the OTR and R ratio of the gas-permeable membrane vary by up to about 5% and that such variations in the results reported below should not be regarded as significant. The size of the membrane and the cover member was 51×76 mm (2×3 inch), except where noted.

EXAMPLE 1

In this example, the gas-permeable membrane was prepared by coating a copolymer of acrylic acid and a mixture of n-alkyl acrylates onto a microporous polyethylene film containing about 60% silica which is available from PPG Industries under the trade name Teslin SP7. The copolymer had a $T_p$ of less than 5° C. At about 22° C., the membrane had an OTR of about 1,550,000 ml/m$^2$•atm•24 hr (100,000 cc/100 in$^2$•atm•24 hr) and an R ratio of about 5.7. At about 7° C., the membrane had an OTR of about 852,500 ml/m$^2$•atm•24 hr (54,000 cc/100 in$^2$•atm•24 hr) and an R ratio of about 6. The cover member was prepared from a coextruded polyethylene/polystyrene film sold under the trade name BF-915 by Barrier Films Corp., which had an OTR of about 5425 ml/m$^2$•atm•24 hr (350 cc/100 in$^2$•atm•24 hr). Table 1 shows the results at room temperature (22–25° C.) using the test set-up illustrated in FIGS. 3 and 4.

TABLE 1

| Run | Holes In Cover | | | % of Membrane | % Drop | % Drop |
|---|---|---|---|---|---|---|
| No. | Diameter mm (inch) | | No. | Covered | In OTR | In R |
| 1 | 12.7 | (0.5) | 4 | 86.91 | −4.98 | 7.14 |
| 2 | 9.5 | (0.375) | 6 | 88.96 | 1.09 | 8.32 |
| 3 | 9.5 | (0.375) | 4 | 92.64 | 1.10 | 14.02 |
| 4 | 9.5 | (0.375) | 1 | 98.16 | 12.79 | 26.72 |

EXAMPLE 2

In this example, the gas-permeable membrane was as in Example 1, but the cover member was prepared from a polyethylene terephthalate film sold under the trade name Mylar OLAF 100 by du Pont, which has an OTR about 0.014 times the OTR of the BF-915 used in Example 1. Table 2 shows the results obtained at room temperature (about 22.5° C.) and 7° C., using the test set-up illustrated in FIGS. 3 and 4, and the $P_{10}$ values calculated from those results. The $P_{10}$ value of the membrane on its own is 1.42.

TABLE 2

| Run | Holes In Cover | | | % in Membrane | % Drop In OTR | | % Drop In R | | |
|---|---|---|---|---|---|---|---|---|---|
| No. | Diameter mm (inch) | | No. | Covered | at 22.5° C. | at 7° C. | at 22.5° C. | at 7° C. | $P_{10}$ |
| 1 | 15.9 | (0.625) | 1 | 94.89 | −2.16 | −0.77 | 15.1 | 12.3 | 1.28 |
| 2 | 9.5 | (0.375) | 1 | 98.16 | 9.35 | 8.24 | 23.5 | 8.95 | 1.40 |
| 3 | 6.35 | (0.25) | 1 | 99.18 | 22.27 | 14.88 | 36.83 | 22.97 | 1.31 |
| 4 | 3.18 | (0.125) | 1 | 99.80 | 34.45 | 33.8 | 63.23 | 43.99 | 1.30 |
| 5 | 1.59 | (0.0625) | 1 | 99.95 | 42.89 | 63.73 | 75.72 | 52.69 | 1.36 |

EXAMPLE 3

In this example, the gas-permeable membrane was prepared by coating Teslin SP7 with polyethylene glycol methacrylate sold under the trade name MPEG 350 by International Specialty Chemicals. The membrane had an OTR of about 821,500 ml/m$^2$•atm•24 hr (53,000 cc/100 in$^2$•atm•24 hr) and an R ratio of about 11.84. The cover member was Mylar OLAF 100. Table 3 shows the results obtained at room temperature (about 22° C.) using the test set-up shown in FIGS. 3 and 4.

TABLE 3

| Run | Holes In Cover | | | % of Membrane | % Drop | % Drop |
|---|---|---|---|---|---|---|
| No. | Diameter mm (inch) | | No. | Covered | In OTR | In R |
| 1 | 9.5 | (0.375) | 1 | 98.16 | 19.56 | 22.79 |
| 2 | 6.35 | (0.25) | 1 | 99.18 | 11.34 | 45.18 |
| 3 | 3.18 | (0.125) | 1 | 99.80 | 41.66 | 75.55 |
| 4 | 1.59 | (0.0625) | 1 | 99.95 | 38.27 | 77.69 |

EXAMPLE 4

In this example, the gas-permeable membrane was the same as in Example 1. Samples of the membrane 5.1×5.1 mm (2×2 inch) were heat-sealed at the edges to cover members composed of Mylar OLAF 100 and having apertures. The resulting assemblies were used as atmosphere-control members on packages containing trays of 1.14 kg (2.5 lb) of whole strawberries, and the steady state atmosphere within the packages was monitored at intervals of 3 days over a period of 13 days at 5° C. TabLe 4 shows the average concentrations of $O_2$ and $CO_2$ and their range of variation, and the percentage drops in OTR and R.

TABLE 4

| Run | Holes in Cover | | % of Membrane | | | % Drop | % Drop |
|---|---|---|---|---|---|---|---|
| No. | Diameter mm (inch) | No. | Covered | % $O_2$ | % $CO_2$ | In OTR | In R |
| 1 | 9.5 (0.375) | 4 | 88.96 | 10.5 ± 2.13 | 4.02 ± 1.1 | 0 | 10 |
| 2 | 6.35 (0.25) | 1 | 98.77 | 6.9 ± 0.23 | 8.4 ± 0.18 | 27 | 35 |
| 3 | 9.5 (0.375) | 4 | 88.96 | 11.4 ± 2.3 | 4.0 ± 0.83 | 0 | 10 |
| 4 | 6.35 (0.25) | 1 | 98.77 | 8.8 ± 0.94 | 7.8 ± 0.64 | 23 | 33 |

What is claimed is:

1. A container which (a) is composed of (i) one or more barrier sections which are relatively impermeable to $O_2$ and $CO_2$, and (ii) one or more atmosphere-control members which are relatively permeable to $O_2$ and $CO_2$; and (b) can be sealed around a respiring biological material to provide a sealed package which is surrounded by air and which contains a packaging atmosphere around the biological material;

at least one said control member comprising (a) a gas-permeable membrane composed of (i) a microporous film having an R ratio of about 1, and (ii) a polymeric coating on the microporous film; and (b) an apertured cover member which, when the container has been sealed around a respiring biological material to provide a said sealed package, lies between the gas-permeable membrane and the air surrounding the package;

the gas permeable membrane having, in the absence of the apertured cover member, (i) an $O_2$ permeability, $OTR_{perm}$, of at least 155,000 ml/m$^2$•atm•24 hr (10,000 cc/100 in$^2$•atm•24 hr), and (ii) a permeability ratio, $R_{perm}$, of at least 2, and the apertured cover member being composed of (i) a barrier portion having an $O_2$ permeability, $OTR_{bar}$, which is less than 0.5 times $OTR_{perm}$, and (ii) an aperture portion which comprises at least one aperture having an area of at least 0.015 in$^2$ and through which the gas-permeable membrane is exposed to the air surrounding the package, the aperture portion being such that the control member has a permeability ratio, $R_{control}$, of at most 0.9 times $R_{perm}$.

2. A container according to claim 1 wherein (a) $R_{control}$ is (i) greater than 1.00 and (ii) at most 0.8 times $R_{perm}$, (b) $OTR_{bar}$ is less than 0.01 times $OTR_{perm}$, and (c) the gas-permeable membrane has an area $A_{perm}$, and the aperture portion of the cover member has an area $A_{open}$ which is at most 0.04 times $A_{perm}$.

3. A container according to claim 1 wherein the aperture portion of the cover member consists of one or more apertures, each said aperture having an area, $A_{aperture}$, less than 0.155 in$^2$.

4. A container according to claim 1 wherein the aperture portion of the cover member consists of one or more apertures, each said aperture having a periphery whose length is less than 2 in (51 mm).

5. A container according to claim 1 wherein $OTR_{perm}$ is less than 3,100,000 ml/m$^2$•atm•24 hr (200,000 cc/100 in$^2$•atm•24 hr).

6. A container according to claim 1 wherein (a) the microporous polymeric film has an $O_2$ permeability of at least 11,625,000 ml/m$^2$•atm•24 hr (750,000 cc/100 in$^2$•atm•24 hr), and (b) the polymeric coating on the microporous film is such that the gas-permeable membrane has an $O_2$ permeability, $OTR_{perm}$, of 387,000 to 2,325,000 ml/m$^2$•atm•24 hr (25,000 to 150,000 cc/100 in$^2$•atm•24 hr).

7. A container according to claim 6 wherein the polymeric coating is such that the gas-permeable membrane has a $P_{10}$ ratio, over at least one 10° C. range between −5 and 25° C., of at least 1.3.

8. A container according to claim 7 wherein the gas-permeable membrane has a $P_{10}$ ratio of at least 2.6.

9. A container according to claim 1 which contains a pinhole.

10. A container according to claim 1 wherein at least 75% of the $O_2$ which enters the packaging atmosphere, after the container has been sealed around the biological material and while the sealed package is at 22° C., passes through said at least one atmosphere control member.

11. A package which is stored in air and which comprises (a) a sealed container, and (b) within the sealed container, a respiring biological material and a packaging atmosphere around the biological material;

said container being a container as defined in claim 1 which has been sealed around the biological material.

12. A package according to claim 11 wherein the biological material is selected from cherries, strawberries, raspberries, blueberries, nectarines and peaches.

13. A method of packaging a respiring biological material which comprises (A) placing the biological material in a container as defined in claim 1, and (B) sealing the container around the biological material.

14. A container according to claim 1 wherein the polymer coating on the microporous film has a coating weight of 1.7 to 2.9 g/m$^2$ and is composed of a crystalline polymer having a crystalline melting point, $T_p$, of −5° to 40° C. and a heat of fusion, $\alpha H$, of at least 5 J/g.

15. A container according to claim 14 wherein $T_p$ is 0° to 15° C. and $\Delta H$ is at least 20 J/g.

16. A container according to claim 14 wherein the crystalline polymer is a side chain crystalline polymer having an onset of melting temperature, $T_o$, such that $T_p - T_o$ is less than 10° C.

17. A container according to claim 16 wherein the crystalline polymer has been crosslinked.

18. A container according to claim 1 wherein the polymer coating on the microporous film has a coating weight of 1.7 to 2.9 g/m$^2$ and is composed of a polymer selected from the group consisting of cis-polybutadiene, poly(4-methylpentene), polydimethyl siloxane, and ethylene-propylene rubber.

* * * * *